US007679599B2

(12) United States Patent
Kawai

(10) Patent No.: US 7,679,599 B2
(45) Date of Patent: Mar. 16, 2010

(54) ELECTROPHORETIC DEVICE, METHOD OF DRIVING ELECTROPHORETIC DEVICE, AND ELECTRONIC APPARATUS

(75) Inventor: Hideyuki Kawai, Fujimi-machi (JP)

(73) Assignees: Seiko Epson Corporation, Tokyo (JP); E Ink Corporation, Cambridge, MA (US)

( * ) Notice: Subject to any disclaimer, the term of this patent is extended or adjusted under 35 U.S.C. 154(b) by 1065 days.

(21) Appl. No.: 11/354,835

(22) Filed: Feb. 16, 2006

(65) Prior Publication Data

US 2006/0197738 A1 Sep. 7, 2006

(30) Foreign Application Priority Data

Mar. 4, 2005 (JP) ..... 2005-060532

(51) Int. Cl.
*G09G 3/34* (2006.01)

(52) U.S. Cl. ..... 345/107

(58) Field of Classification Search ..... 345/107, 345/98–100; 359/296, 297
See application file for complete search history.

(56) References Cited

U.S. PATENT DOCUMENTS

2002/0021483 A1* 2/2002 Katase ..... 359/267
2004/0036951 A1* 2/2004 Johnson et al. ..... 359/296
2005/0104844 A1* 5/2005 Nakai et al. ..... 345/107

FOREIGN PATENT DOCUMENTS

| | | |
|---|---|---|
| CN | 1459046 A | 11/2003 |
| JP | A-50-51695 | 5/1975 |
| JP | B2 50-15115 | 6/1975 |
| JP | A 64-086116 | 3/1989 |
| JP | A-2000-035775 | 2/2000 |
| WO | WO 02/073304 A2 | 9/2002 |

* cited by examiner

*Primary Examiner*—Richard Hjerpe
*Assistant Examiner*—Carolyn R Edwards
(74) *Attorney, Agent, or Firm*—Oliff & Berridge, PLC

(57) ABSTRACT

The electrophoretic device of the present invention obtains a plurality of different optical characteristics by changing a proportion of number of pixel electrodes supplied with a first voltage and a number of pixel electrodes supplied with a second voltage. The transition of the optical characteristics accompanied by the changes of the proportion is previously obtained as an actual measurement value. The preferable proportion displaying the desired optical characteristic is calculated based on the actual measurement value.

10 Claims, 12 Drawing Sheets

| BLACK PIXEL NUMBER : WHITE PIXEL NUMBER | |
|---|---|
| (1) | 4 : 0 |
| (2) | 3 : 1 |
| (3) | 2 : 2 |
| (4) | 1 : 3 |
| (5) | 0 : 4 |

-PRIOR ART- FIG. 12A
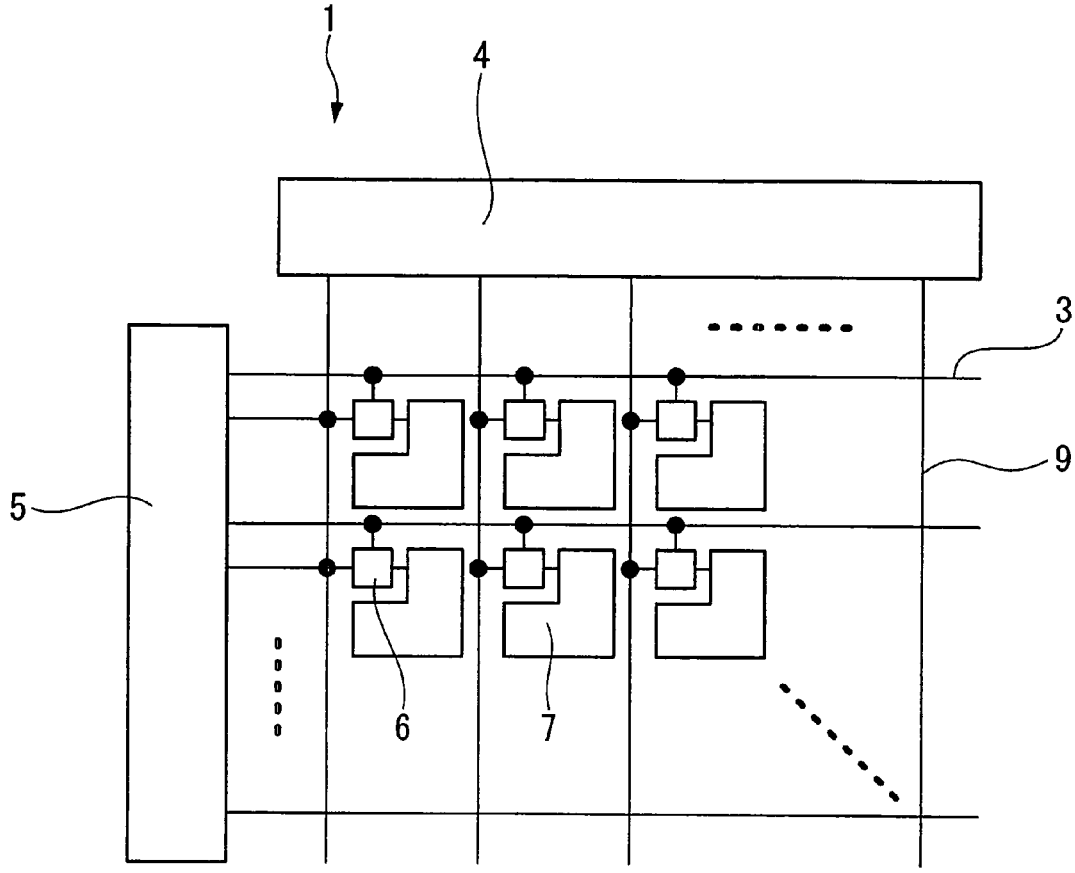
-PRIOR ART- FIG. 12B
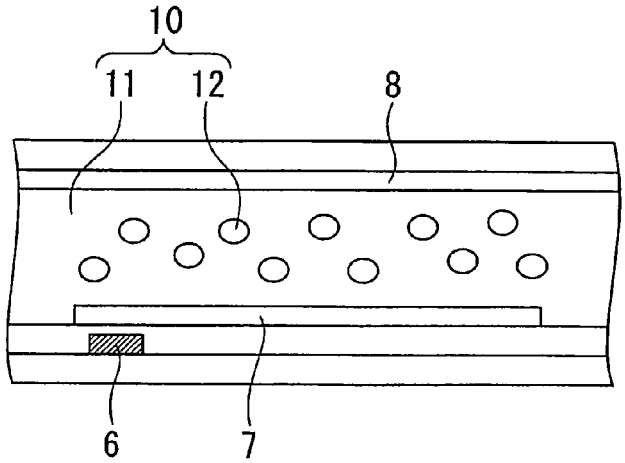

-PRIOR ART-

-PRIOR ART-

-PRIOR ART-

-PRIOR ART-

-PRIOR ART-

FIG. 14A -PRIOR ART-
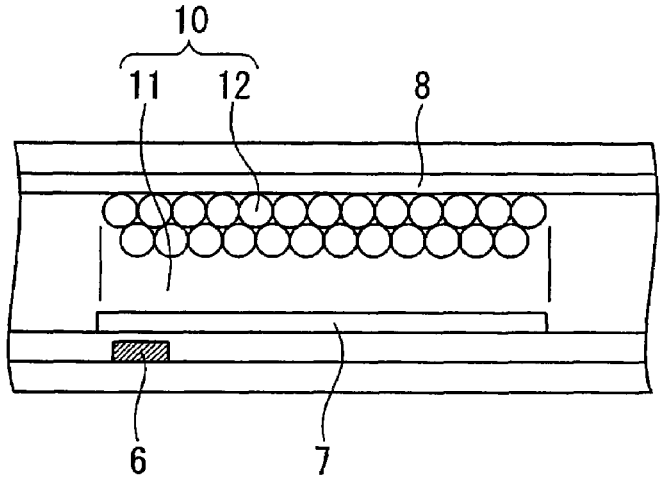
FIG. 14B -PRIOR ART-
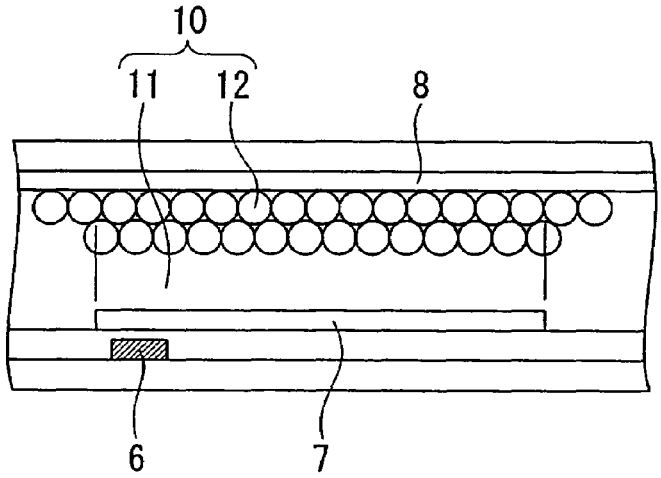
FIG. 14C -PRIOR ART-
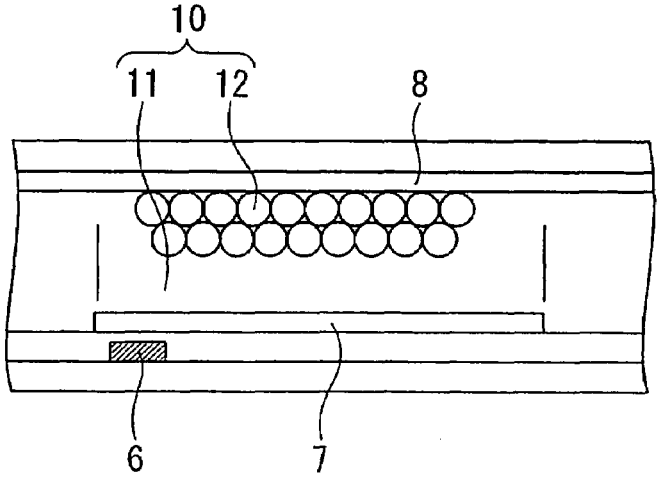

ELECTROPHORETIC DEVICE, METHOD OF DRIVING ELECTROPHORETIC DEVICE, AND ELECTRONIC APPARATUS

BACKGROUND OF THE INVENTION

1. Field of the Invention

The present invention relates to an electrophoretic device, method of driving electrophoretic device, and electronic apparatus. In particular, the invention relates to an electrophoretic device that has an electrophoretic dispersion liquid including a liquid dispersion medium and electrophoretic particles, to method of driving electrophoretic device, and to electronic apparatus comprising the electrophoretic device which uses the driving method.

Priority is claimed on Japanese Patent Application No. 2005-60532, filed Mar. 4, 2005, the content of which is incorporated herein by reference.

2. Description of Related Art

In relation to an electrophoretic device which has an electrophoretic dispersion liquid including a liquid dispersion medium and electrophoretic particles, there is heretofore known an electrophoretic display device that utilizes the fact that when an electric field is applied to the electrophoretic dispersion liquid, a distribution of the electrophoretic particles is changed and an optical characteristic of the electrophoretic dispersion liquid changes (for example, refer to Japanese Examined Patent Application, Second Publication No. S50-15115). Since such an electrophoretic device does not require a backlight, it can contribute to reducing the cost, and making the display device thinner. Further, the electrophoretic display device has a memory property of the display in addition to a wide angle of visibility and a high contrast. Therefore, it is drawing attention as the next generation display device.

Moreover, there has been proposed a method wherein the electrophoretic dispersion liquid is encapsulated in a microcapsule in an electrophoretic display device (for example, refer to Japanese Unexamined Patent Application, First Publication No. H01-86116). There are advantages by encapsulating the electrophoretic dispersion liquid in a microcapsule in that spilling of the electrophoretic dispersion liquid during the manufacturing process of the electrophoretic display device can be avoided, and precipitation and aggregation of the electrophoretic particles can be reduced.

Furthermore, there is known an electrophoretic display device which is a combination of such an electrophoretic display device and an active matrix device wherein an electric field is applied to the electrophoretic dispersion liquid by operating the active matrix device so that a distribution of the electrophoretic particles is changed (for example, refer to Japanese Unexamined Patent Application, First Publication No. 2000-35775).

A structure of a conventional electrophoretic display device is shown in FIG. 12. FIG. 12A is a plan view of the electrophoretic display device, and FIG. 12B is a sectional view of a pixel portion in the electrophoretic display device.

As shown in FIG. 12A, an electrophoretic display device 1 has a plurality of data signal lines 9, a plurality of scanning signal lines 3 that intersect the data signal lines, switching elements 6 such as transistors that are arranged at intersections of the data signal lines 9 and the scanning signal lines 3, a data signal operating circuit 4, a scanning signal operating circuit 5, and pixel electrodes 7.

Here, the pixel electrodes 7 can be subjected to an electrical influence by appropriately providing data signals to the data signal lines 9 and scanning signals to the scanning signal lines 3, and then controlling the ON/OFF switching of the switching element 6. For example, when a scanning signal which selects only one of a plurality of the scanning signal lines, is provided while some data signal is being provided to the data signal line, the switching element 6 that is connected to the selected scanning signal line turns ON, and then the data signal line 9 and the pixel electrode 7 are essentially conducted. That is, at this time, a signal (voltage) supplied to the data signal line 9 is supplied to the pixel electrode 7 through the switching element 6 that is ON. In contrast, a switching element that is connected to the unselected scanning signal line remains OFF, and the data signal line and the pixel electrode are essentially non-conducted.

In this manner, since the electrophoretic display device can selectively turn ON/OFF only the transistor that is connected to a desired scanning signal line, a cross talk problem hardly occurs and it is possible to speed up the circuit operation.

As shown in the sectional view of FIG. 12B, in a general example of a conventional electrophoretic display device, the pixel electrode 7 and a common electrode 8 are provided to oppose each other with a predetermined space therebetween (normally from several μm to several tens of μm). In the space formed between the electrodes, an electrophoretic dispersion liquid 10 that includes a liquid dispersion medium 11 and electrophoretic particles 12 is enclosed. Here, for the sake of simplification, the data signal line and the scanning signal line are omitted in FIG. 12B.

With such a structure, when the above-mentioned operation is conducted and a desired data signal (voltage) is supplied to the pixel electrode 7 while maintaining the common electrode 8 at a predetermined voltage, the electrophoretic particles 12 migrate according to a voltage potential difference (electric field) generated between the common electrode and the pixel electrode, and the spatial distribution is changed. For example, when the electrophoretic particles 12 are positively charged, if the earth potential (0V) is supplied to the common electrode 8 and a negative voltage is supplied to the pixel electrode 7, then the electrophoretic particles 12 are attracted onto the pixel electrode. Conversely, if a positive voltage is supplied to the pixel electrode 7, the electrophoretic particles 12 are attracted onto the surface of the common electrode that is opposed to the pixel electrode. The movement goes the other way around when the electrophoretic particles 12 are negatively charged. Based on such a principal, a desired image can be obtained by appropriately controlling the data signal (voltage) provided to each pixel.

Moreover, as a method for realizing the gradation expression in a conventional electrophoretic display device, there is known a method, referred to as area gradation, wherein a plurality of minute pixel pieces are collected to constitute one pixel and the gradation display of overall pixels is obtained by ON/OFF combination of the respective minute pixel pieces (for example, refer to Japanese Unexamined Patent Application, First Publication No. S50-51695). In the area gradation, each pixel displays either one of; a first optical characteristic state (for example, a state where all electrophoretic particles are deposited on the pixel electrode in FIG. 12B), and a second optical characteristic state (similarly, a state where all electrophoretic particles are deposited on the surface of the common electrode opposed to the pixel electrode in FIG. 12B). Moreover, regarding a plurality of pixels included in a certain region, by adjusting the proportion of the number of pixels displaying the first optical characteristic state and the number of pixels displaying the second optical characteristic state, the average optical characteristic in the region can display the value between the first optical characteristic and the second optical characteristic. Here, in order to make a pixel display the first optical characteristic state, a first voltage is applied to the pixel. On the other hand, in order to make a pixel display the second optical characteristic state, a second voltage is applied to the pixel. In the above example, a negative voltage becomes the first voltage and a positive voltage becomes the second voltage.

The area gradation is further specifically described. As shown in FIG. 13, a display region 2 comprising four pixel electrodes 7 is taken into consideration. Here, the first optical characteristic state is black and the second optical characteristic state is white. In FIG. 13A, the first voltage is applied to all pixels, therefore displaying the first optical characteristic state (that is, the proportion is 4:0). In FIG. 13B, the first voltage is applied to three pixels and the second voltage is applied to the remaining one pixel. As a result, the three pixels display the first optical characteristic state and the remaining one pixel displays the second optical characteristic state (that is, the proportion is 3:1). The proportion is changed in the order of 2:2, 1:3, and 0:4 as shown in C, D, and E. In such a case, the average optical characteristic for the whole region is clearly the first optical characteristic in FIG. 13A and the second optical characteristic in FIG. 13E. However, in the state therebetween, the average optical characteristic becomes the optical characteristic proportionally distributed between the first optical characteristic and the second optical characteristic corresponding to the proportion of the pixel number in the first optical characteristic state and the second optical characteristic state.

For example, the reflectance is considered as the optical characteristic, and it is assumed that the reflectance of the black pixel is Rb and the reflectance of the white pixel is Rw. At this time, the average reflectance in the overall region in FIG. 13A to FIG. 13E becomes as follows respectively.

FIG. 13A: $(4Rb+0Rw)/4=Rb$

FIG. 13B: $(3Rb+Rw)/4$

FIG. 13C: $(2Rb+2Rw)/4=(Rb+Rw)/2$

FIG. 13D: $(Rb+3Rw)/4$

FIG. 13E: $(0Rb+4Rw)/4=Rw$

That is, corresponding to the proportion of the white and black pixel number, the reflectance proportionally distributed between Rb and Rw can be expressed.

In such an area gradation, since the gradation is determined by the digital value as the proportion of the pixel number, it is hardly affected by the characteristic difference by each pixel. Furthermore, since it can be controlled by a digital circuit without requiring an analog circuit such as a digital/analogue converter, it is effective in simplifying the control circuit and improving the reliability. However, conversely, since the displayed gradation becomes the average value in a certain region as described above, there is a problem in that, if the pixel size is too large, averaging is not performed by the naked eye and the image appearance is worsened. However, regarding this point, since miniaturization of the pixel size is well advanced due to high quality thin-film circuits, for example represented by a low temperature polysilicon thin-film transistor, it is not considered to become a big problem in the future.

However, there are the following problems in the conventional techniques.

In an electrophoretic display device, electrophoretic particles are deposited ideally on the pixel electrode or the surface of the common electrode opposed to the pixel electrode. However, actually in some cases, electrophoretic particles overflow the ideally deposited region due to the leakage of the electric field passing through the electrophoretic dispersion liquid.

The case is described with reference to the drawings. For example, in the electrophoretic display device having the structure shown in FIG. 12B, as described above, when the electrophoretic particles 12 are positively charged, if the earth potential (0V) is supplied to the common electrode 8 and a positive voltage is supplied to the pixel electrode 7, then the electrophoretic particles 12 are attracted onto the surface of the common electrode opposed to the pixel electrode. At this time, ideally as shown in FIG. 14A, the electrophoretic particles 12 are deposited only in a region on the common electrode opposed to the pixel electrode. However, actually in some cases, since the electric field from the pixel electrode to the common electrode leaks horizontally to some degree, the particles overflow from the ideal region and are deposited as in FIG. 14B, or they are deposited inside of the ideal region as in FIG. 14C. In such a case, the pixel size in appearance viewed from the common electrode side becomes larger in FIG. 14B, and smaller in FIG. 14C, than the actual pixel electrode size. Furthermore, if the structure is such that a plurality of pixel electrodes are arranged in matrix form, the manner of leaking differs according to the state of voltage applied to the adjacent pixel electrode. Consequently, in the actual area gradation, even if the first voltage or the second voltage is appropriately applied to respective pixels in order to obtain the desired proportion of the pixel number of the first optical characteristic state, and the pixel number of the second optical characteristic state, the pixel area ratio in appearance becomes different, causing a problem of inability to obtain the desired optical characteristic.

SUMMARY OF THE INVENTION

Therefore, an object of the present invention is to provide an electrophoretic device, a method of driving an electrophoretic device, and electronic apparatus, by which a desired optical characteristic can be obtained by using an area gradation method.

In order to solve the above-mentioned problems in the conventional technology, in the electrophoretic device of the present invention, the optical characteristic when changing the proportion of the number of pixel electrodes supplied with the first voltage and the number of pixel electrodes supplied with the second voltage is previously measured, so that when an image is displayed, the proportion corresponding to the desired optical characteristic is calculated based on the measurement value.

That is, the electrophoretic device of the present invention has: an electrophoretic dispersion liquid that includes a liquid dispersion medium and electrophoretic particles; a plurality of pixel electrodes; and a voltage supply device that separately supplies a plurality of the pixel electrodes with the first voltage or the second voltage, and is constituted so that a plurality of different optical characteristics may be obtained by changing a proportion of the number of pixel electrodes supplied with the first voltage and the number of pixel electrodes supplied with the second voltage, and the optical characteristic when changing the proportion is previously measured, so that when an image is displayed, the proportion corresponding to the desired optical characteristic is calculated based on the measurement value.

Due to the above-mentioned structure, there is an effect that an electrophoretic device which may reliably realize the desired optical characteristics may be provided.

Furthermore, in the electrophoretic device of the present invention, by previously measuring the optical characteristic when changing the proportion, a function $R=f(x)$ representing the relationship of the proportion x and the actual measurement value R of the optical characteristic is obtained, and when an image is displayed, a proportion corresponding to a desired optical characteristic is calculated by substituting the desired optical characteristic into an inverse function $x=f^{-1}(R)$ of the function.

Due to the above-mentioned structure, there is an effect that the proportion of the pixel number for obtaining the desired optical characteristic may be calculated more accurately.

Moreover, in the electrophoretic device of the present invention, the electrophoretic particles include a plurality of types of particles having different optical characteristics. Due to the above-mentioned structure, there is an effect that the change in the complex optical characteristic such as brightness or chroma may be expressed.

Furthermore, the structure may be such that the electrophoretic dispersion liquid is encapsulated in a microcapsule. By filling the electrophoretic dispersion liquid into a microcapsule, spilling of the dispersion liquid during the manufacturing process of the electrophoretic device may be avoided, and precipitation and aggregation of the electrophoretic particles may be reduced.

Moreover, in the electrophoretic device of the present invention, the pixel electrodes are arranged in matrix form. Due to the above-mentioned structure, there is an effect that images of complex shape may be displayed.

Furthermore, the electrophoretic device of the present invention has a common electrode, and the pixel electrode and the common electrode are formed on a same substrate.

In the method of driving the electrophoretic device of the present invention, the electrophoretic device has: an electrophoretic dispersion liquid that includes a liquid dispersion medium and electrophoretic particles; a plurality of pixel electrodes; and a voltage supply device that separately supplies a plurality of the pixel electrodes with a first voltage or a second voltage, and is constituted so that a plurality of different optical characteristics may be obtained by changing a proportion of the number of pixel electrodes supplied with the first voltage and the number of pixel electrodes supplied with the second voltage, the optical characteristic when changing the proportion is previously measured, so that when an image is displayed, the proportion corresponding to the desired optical characteristic is calculated based on the measurement value, and the first voltage or the second voltage is supplied from the voltage supply device to a plurality of the pixel electrodes corresponding to the calculated proportion.

Due to the above-mentioned structure, there is an effect that a method of driving an electrophoretic device which may reliably realize the desired optical characteristics may be provided.

Furthermore, in the method of driving the electrophoretic device of the present invention, by previously measuring the optical characteristic when changing the proportion, a function $R=f(x)$ representing the relationship of the proportion x and the actual measurement value R of the optical characteristic is calculated, and when an image is displayed, a proportion corresponding to a desired optical characteristic is calculated by substituting the desired optical characteristic into an inverse function $x=f^{-1}(R)$ of the function, and the first voltage or the second voltage is supplied from the voltage supply device to the plurality of pixel electrodes corresponding to the calculated proportion.

Furthermore, the electronic apparatus of the present invention includes any one of the above-mentioned electrophoretic devices. Due to the above-mentioned structure, there is an effect that electronic apparatus having a display device which may reliably realize the desired optical characteristics may be provided.

BRIEF DESCRIPTION OF THE DRAWINGS

FIG. 12A is a plan view of the electrophoretic display device showing a structure of a conventional electrophoretic device.

FIG. 12B is a sectional view showing the structure of a pixel portion of the conventional electrophoretic device.

FIGS. 14A to 14C are sectional views showing electrophoretic particles in a conventional electrophoretic device.

DETAILED DESCRIPTION OF THE INVENTION

Hereunder is a description of embodiments of the present invention with reference of drawings.

Embodiment 1

Figure 1A:
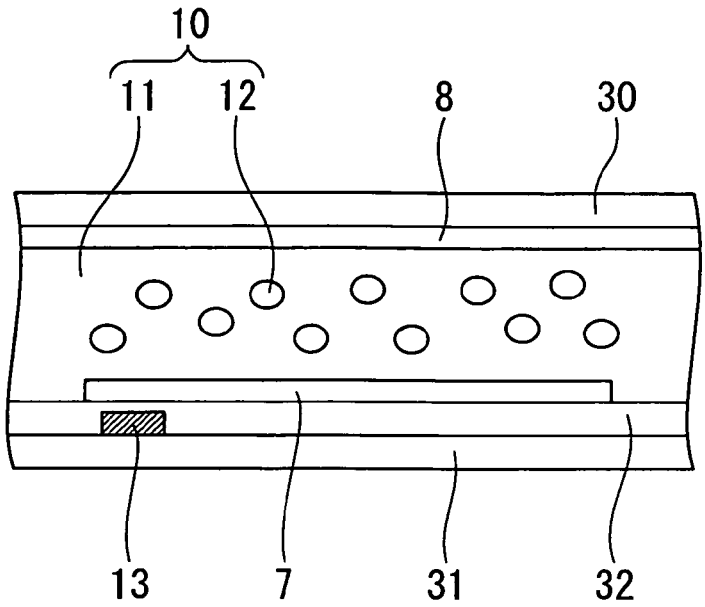
FIG. 1A is a sectional view of a pixel, showing a first embodiment of an electrophoretic device according to the present invention.
Figure 1B:
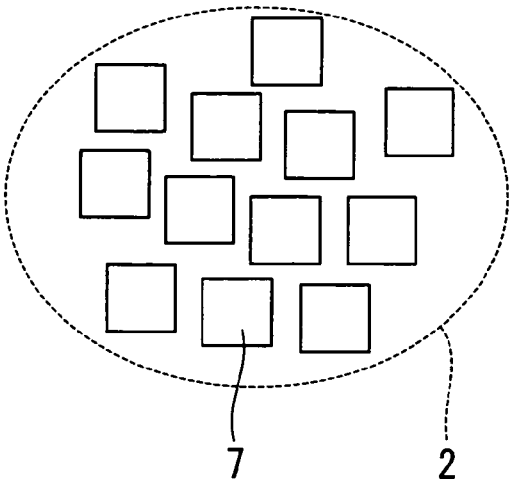
FIGS. 1B and 1C are schematic views showing the pixel structure.
Figure 1C:
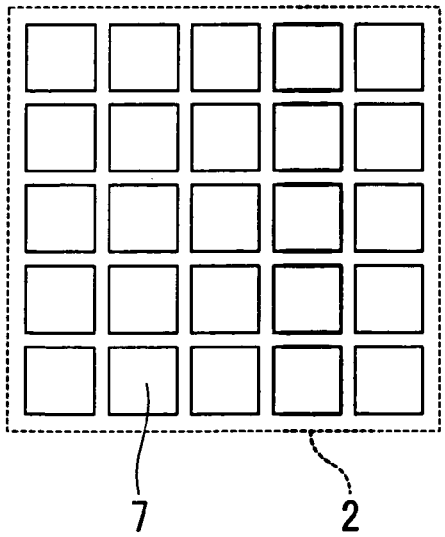

FIG. 1 shows a first embodiment of an electrophoretic device according to the present invention, wherein FIG. 1A is a sectional view of a pixel, and FIGS. 1B and 1C show the pixel structure.

As shown in FIG. 1A, the present electrophoretic device includes a first substrate 30, a common electrode 8 formed on the first substrate, a second substrate 31, a insulating layer 32, a pixel electrode 7 arranged on the common electrode side of the second substrate, and a voltage supply circuit 13 which supplies a first voltage or a second voltage to the pixel electrode. The pixel electrode 7 and the common electrode 8 are arranged to oppose each other with a predetermined space formed by a member (not shown) such as a spacer, a partition, or the like. Furthermore, an electrophoretic dispersion liquid 10 that includes a liquid dispersion medium 11 and electrophoretic particles 12, is filled in the space between the pixel electrode 7 and the common electrode 8.

Hereunder is a description of the operation of the present electrophoretic device. In the following description, it is assumed that the liquid dispersion medium 11 is dyed black and the electrophoretic particles 12 are white and positively charged. However, the assumption is simply for the sake of convenience, and the liquid dispersion medium and the electrophoretic particles may be in any color. Moreover, even if the electrophoretic particles are negatively charged, the direction of applying the voltage need only be reversed, and the same principal can be applied for explanation.

In FIG. 1A, when the negative first voltage (for example −10V) is applied to the pixel electrode while keeping the common electrode 8 at the earth potential (i.e., 0V), an electric field is generated from the common electrode to the pixel electrode, and the positively charged electrophoretic particles migrate toward the pixel electrode along the electric field. Consequently, the color of the liquid dispersion medium, that is black, is observed from the common electrode side. On the other hand, when the positive second voltage (for example +10V) is applied to the pixel electrode while keeping the common electrode 8 at the earth potential (0V), an electric field is generated from the pixel electrode to the common electrode. Therefore, the positively charged electrophoretic particles migrate toward the common electrode. Consequently, the color of the electrophoretic particles, that is white, is observed from the common electrode side.

Here, the following can be used as the liquid dispersion medium 11, though it is not limited particularly to this. For example, water, methanol, ethanol, isopropanol, butanol, octanol, methyl cellosolve, and other alcohol-based solvents, ethyl acetate, butyl acetate, and other various esters, acetone, methylethylketone, methylisobutylketone, and other ketones, pentane, hexane, octane, and other aliphatic hydrocarbons, cyclohexane, methylcyclohexane, and other alicyclic hydrocarbons, benzene, toluene, xylene, hexylbenzene, hebutylbenzene, octylbenzene, nonylbenzene, decylbenzene, undecylbenzene, dodecylbenzene, tridecylbenzene, tetradecylbenzene, and other aromatic hydrocarbons such as benzenes having long-chain alkyl groups, methylene chloride, chloroform, carbon tetrachloride, 1,2-dichloroethane, and other halogenated hydrocarbons, carboxylates, and other various oils and the like alone or in mixtures plus a surfactant etc.

Furthermore, the liquid dispersion medium 11 may be substantially transparent or may be opaque. Moreover, if necessary, it may be appropriately colored with a desired color. The following can be used as a colorant to color the liquid dispersion medium 11, though it is not limited particularly to this. For example, anthraquinone series, azo series, diazo series, amine series, diamine series, and other chemical compound dyes, cochineal dye, carminic acid dye, and other natural dyes, azo series, polyazo series, anthraquinone series, quinacridone series, isoindolene series, isoindolenone series, phthalocyanine series, perylene series, and other organic pigments, carbon black, silica, chromic oxide, iron oxide, titanium oxide, zinc sulphide, and other inorganic pigments alone or in mixtures.

Moreover, the electrophoretic particle 12 is an organic or inorganic particle, or a compound particle that electrophoretically migrates in the dispersion medium due to the potential difference. The following can be used as the electrophoretic particle 12, though it is not limited particularly to this. For example, aniline black, carbon black, or other black pigments, titanium dioxide, zinc oxide, antimony trioxide, and other white pigments, monoazo, dis-azo, polyazo, and other azo-based pigments, isoindolenone, chrome yellow, yellow iron oxide, cadmium yellow, titanium yellow, antimony, and other yellow pigments, monoazo, dis-azo, polyazo, and other azo-based pigments, quinacrilidone red, chrome vermillion, and other red pigments, phthalocyanine blue, indanthrene blue, anthraquinone-based dyes, prussian blue, ultramarine blue, cobalt blue, and other blue pigments, phthalocyanine green and other green pigments alone or in combinations of two or more types.

Furthermore, if necessary, the following substance may be added to the above-mentioned pigment: electrolyte, anionic, cationic, nonionic and other various surfactants, charge controlling agents that consist of particles of metal soap, resin, rubber, oil, varnish, compounds and the like, titanium-based coupling agent, aluminum-based coupling agent, silane-based coupling agent, and other coupling agents, various polymer dispersants that consist of a single or a plurality of block polymers such as polyethylene oxide, polystyrene, acrylic, and other macromolecules, lubricants, stabilizers, and the like.

As the voltage supply circuit 13, for example, semiconductor elements such as a transistor and a diode, a mechanical switch and the like may be applied. By appropriately controlling the voltage supply circuit 13, a desired voltage, that is, the first voltage or the second voltage is supplied to the pixel electrode 7.

As shown in FIGS. 1B and 1C, in the present electrophoretic device, a display region 2 is constituted by N pixel electrodes 7. The pixel electrodes may be arranged comparatively at random as in FIG. 1B, or they may be arranged in matrix form as in FIG. 1C. However, orderly arrangement of pixels in matrix form is more preferable since images of complex shape can be displayed more accurately.

Here, the value of N in the actual display device is determined in consideration of the pixel size, image to be displayed, desired gradation to be expressed, and the like. As N becomes greater, possible gradation to be expressed is increased, but the size of the display region 2 is increased, leading deterioration of the image quality. The smaller the pixel size becomes, the more minute the image that can be displayed.

In the description hereunder, for the sake of simplification, as examples, the reflectance is used for the optical characteristic, black (that is low reflectance state) is used for a first optical characteristic, and white (that is high reflectance state) is used for a second optical characteristic state. However, the examples are simply for the sake of convenience, and essentially similar methods may be applied to other cases, for example a case where the optical characteristic is hue, chroma, or the like.

Firstly, in the pixel structure of FIG. 1C, the reflectance in the case where the proportion of pixels in the black state and pixels in the white state is changed as follows, is measured.

| | Black pixel number:White pixel number | Reflectance |
|---|---|---|
| (0) | N:0 | R1 |
| (1) | N − 1:1 | R2 |
| (2) | N − 2:2 | R3 |
| (i) | N − i:i | Ri |
| (i + 1) | N − i − 1:i + 1 | Ri + 1 |
| (N) | 0:N | RN |

Next, when a desired image is displayed, the proportion corresponding to the desired reflectance is obtained based on the measurement value. Corresponding to the calculated proportion, the first voltage or the second voltage is supplied from the voltage supply circuit 13 to the respective pixel electrodes 7. For example, if the reflectance Ri is desired to be expressed, the proportion of the black pixel number: white pixel number may be N−i: i. More specifically, the first voltage is applied to (N−i) pixels and the second voltage is applied to the remaining i pixels.

Here, if the desired reflectance is between Ri and Ri+1, the proportion that is closer to either one of them may be employed for example. Alternatively, if there are a plurality of display regions, by arranging the reflectance Ri region and the reflectance Ri+1 region side by side, the overall average reflectance of the two regions may be the middle of Ri and Ri+1.

In a conventional electrophoretic display device, when obtaining a desired reflectance, the proportion of the pixel number obtained by proportional distribution calculation has been used. That is, for example when obtaining the reflectance Ri, the control has been performed assuming that the white pixel number is (((Ri−R1)/(RN−R1))×N) and the black pixel number is (N—white pixel number). However, since the pixel size in appearance is different from the size of the pixel electrode due to the leakage of the electric field as described above, a desired reflectance can not be obtained in such a conventional method. On the other hand, in the method of the present invention, since the proportion of the pixel number is obtained using the actual measurement value, the desired reflectance can be expressed more accurately.

Embodiment 2

FIG. 2 shows a second embodiment of the electrophoretic device according to the present invention.

Figure 2A:
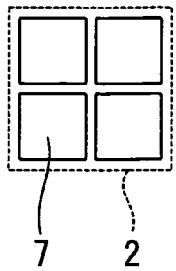
FIG. 2A is a schematic view of the structure of a pixel portion, showing a second embodiment of the electrophoretic device according to the present invention.

FIG. 2A shows the pixel structure. In the present electrophoretic device, the display region 2 includes four pixel electrodes 7 having two arranged horizontally and two vertically. In the description hereunder, as examples, the reflectance is used for the optical characteristic, black (that is low reflectance state) is used for a first optical characteristic, and white (that is high reflectance state) is used for a second optical characteristic. However, the examples are simply for the sake of convenience as described above.

Figure 2B:
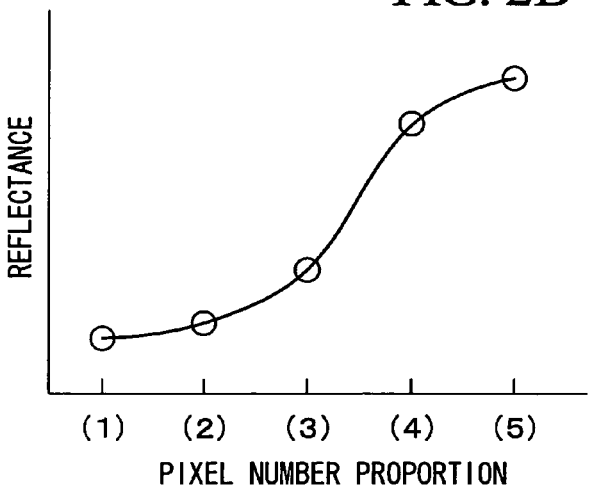
FIG. 2B is a chart showing an example of a function of the relationship between the proportion of the pixel number and the reflectance.

FIG. 2B is an example of the reflectance measurement data in the case where the proportion of the black pixel number and the white pixel number is changed in the electrophoretic display device having such a pixel structure. A spectrophotometer, SpectroEye made by GretagMacbeth AG. was used for the measurement of reflectance. Although the number of the measurement data is limited, an approximating curve can be obtained from the data as shown in the graph. The present approximating curve shows the function R=f(x) that represents the relationship of x and R assuming that the proportion of the black pixel number and the white pixel number is x and the reflectance is R.

Figure 2C:
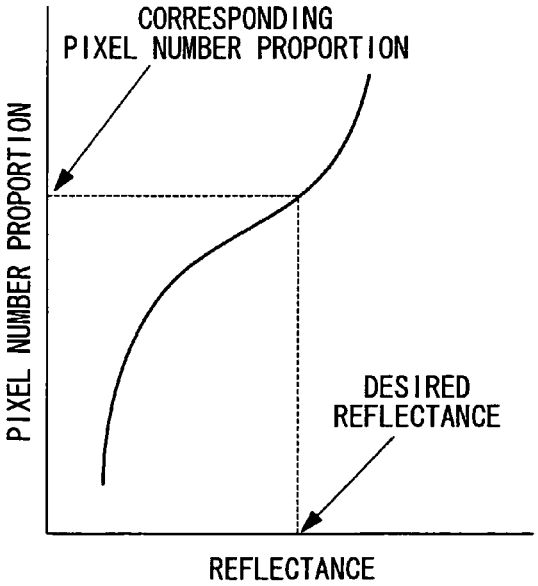
FIG. 2C is a chart showing the inverse function of the function of FIG. 2B.

Next, when displaying the desired image, by substituting the desired reflectance into the inverse function $x=f^{-1}(R)$ of the above-mentioned function, the proportion corresponding to the desired reflectance is calculated. Then, corresponding to the calculated proportion, the first voltage or the second voltage is supplied to the respective pixel electrodes. Here, as to the method for obtaining the inverse function $x=f^{-1}(R)$, for example if the function R=f(x) is given in a numerical formula such as a higher degree polynomial, it can be obtained by calculation. Alternatively if the function R=f(x) is given in a curved line as in FIG. 2B, it can be obtained by replacing the x-axis and y-axis (i.e., the transverse axis and longitudinal axis) of the curved line. FIG. 2C shows a curve of the inverse function $x=f^{-1}(R)$ obtained by the latter method, that is to replace x-axis and y-axis of the curved line of FIG. 2B representing the function. The proportion of the pixel number corresponding to the desired reflectance can be obtained using the curved line of FIG. 2C.

Figure 2D:
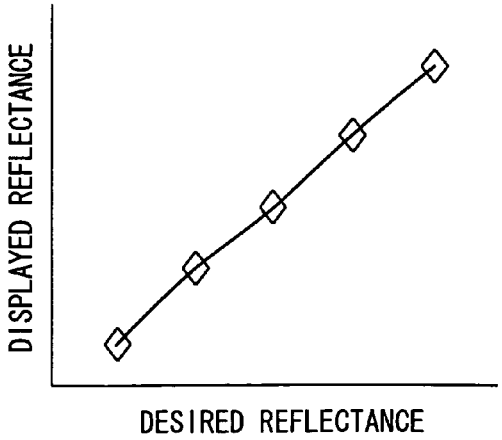
FIG. 2D is a chart showing a measurement example for when the present embodiment is applied.

FIG. 2D shows the relationship between the desired reflectance and the actually displayed reflectance when using the above-mentioned method, and it is found that excellent linearity can be obtained. In this manner, in the method of the present invention, the desired reflectance can be expressed more accurately.

Embodiment 3

Figure 3:
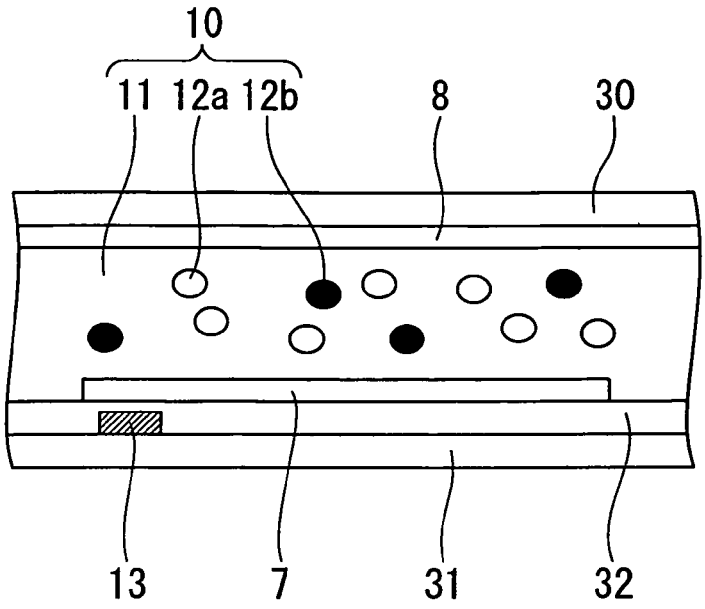
FIG. 3 is a sectional view showing the structure of a pixel portion in a third embodiment of the electrophoretic device according to the present invention.

FIG. 3 is a sectional view showing the structure a pixel portion in a third embodiment of the electrophoretic device according to the present invention.

In the present embodiment, as shown in FIG. 3, the electrophoretic particles include two different types of particles 12*a* and 12*b*. Other components are similar to those in the above-mentioned Embodiment 1.

Hereunder is a description of the operation of the electrophoretic device according to the present embodiment. In the following description, it is assumed that the electrophoretic particles 12*a* are white and positively charged and the electrophoretic particles 12*b* are black and negatively charged. However, the color of the particles and the charging polarity is not specifically limited. For example, even if the charging polarity is reversed, the direction of applying the voltage need only be reversed, and the same principal can be applied for explanation.

In FIG. 3, when the negative first voltage (for example −10V) is applied to the pixel electrode while keeping the common electrode 8 at the earth potential (i.e., 0V), an electric field is generated from the common electrode to the pixel electrode, and the positively charged electrophoretic particles 12*a* migrate toward the pixel electrode along the electric field whereas the negatively charged electrophoretic particles 12*b* migrate toward the common electrode. At this time, if observed from the common electrode side, the color of the electrophoretic particles 12*b*, that is black, is observed on the overall display region. On the other hand, when the positive second voltage (for example +10V) is applied to the pixel electrode while keeping the common electrode 8 at the earth potential (i.e., 0V), an electric field is generated from the pixel electrode to the common electrode. Therefore, the positively charged electrophoretic particles 12*a* migrate toward the common electrode, and the negatively charged electrophoretic particles 12*b* migrate toward the pixel electrode.

Consequently, the color of the electrophoretic particles 12*a*, that is white, is observed from the common electrode side.

For the liquid dispersion medium 11 and the electrophoretic particle 12 in the present embodiment, materials similar to those described in Embodiment 1 may be used.

Moreover, the liquid dispersion medium 11 in the present embodiment may be substantially transparent or may be opaque. Furthermore, if necessary, it may be appropriately colored with a desired color.

In the description above, though the electrophoretic particle consists of two different types of particles, the structure may be that the electrophoretic particle consists of three or more different types of particles. In such case, multicolor display becomes possible by adjusting the signal (voltage) applied to the pixel electrode, and controlling the mutual distribution of the three or more different types of particles.

Furthermore, a mixed color of the electrophoretic particles 12*a* and the electrophoretic particles 12*b*, in other words, an intermediate color can also be displayed by appropriately adjusting the magnitude of the signal (voltage) applied to the pixel electrode and the length of time for applying thereto during the above-mentioned image writing operation, so as to control the distribution of the particles.

Embodiment 4

Figure 4:
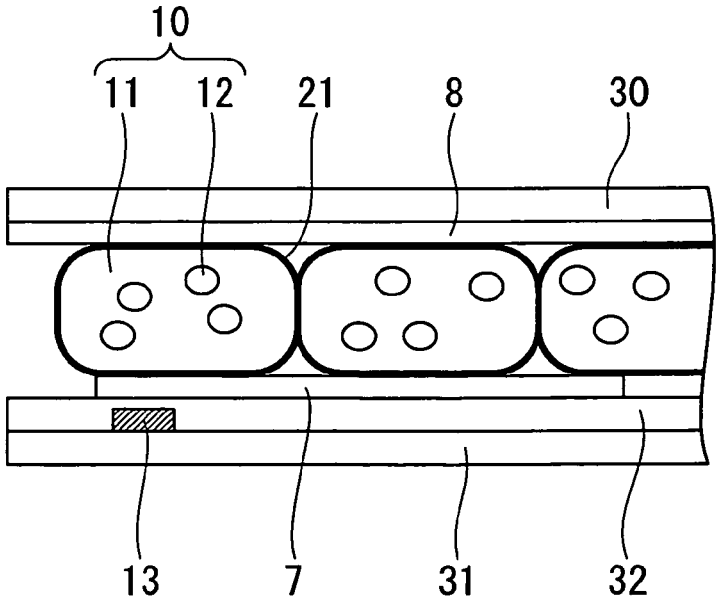
FIG. 4 is a sectional view showing the structure a pixel portion in a fourth embodiment of the electrophoretic device according to the present invention.

FIG. 4 is a sectional view of a pixel portion in a fourth embodiment of the electrophoretic device according to the present invention.

In the present embodiment, as shown in FIG. 4, the electrophoretic dispersion liquid 10 is encapsulated in a microcapsule 21, and arranged between the pixel electrode 7 and the common electrode 8. Other components are similar to those in the above-mentioned Embodiment 2.

The structure may be such that the electrophoretic particles 12 included in the electrophoretic dispersion liquid 10 consist of one type particle as in the Embodiment 1, or two or more different types of particles as in the Embodiment 2.

By encapsulating the electrophoretic dispersion liquid in a microcapsule in this manner, spilling of the dispersion liquid during the manufacturing process of the electrophoretic device can be avoided, and precipitation and aggregation of the electrophoretic particles can be reduced. Furthermore, a member such as a spacer, a partition, or the like for arranging the pixel electrode and the common electrode to oppose each other with a predetermined space, becomes unnecessary. This brings an effect of cost cutting, and enables arrangement of the electrophoretic dispersion liquid between flexible substrates. Moreover, application to electronic paper can be expected.

Examples of wall-film material of the microcapsule 21 include for example, gelatin, polyurethane resin, polyurea resin, urea resin, melamine resin, acrylic resin, polyester resin, polyamide resin, and other various resin materials. Such material alone or in combinations of two or more types may be used.

Moreover, as a method of forming the microcapsule 21, for example, an interfacial polymerization method, in-situ polymerization method, phase separation method, interfacial precipitation method, spray-drying method, and other various micro-capsulation methods can be used.

The size of microcapsules used for the electrophoretic device according to the present invention is preferably uniform. Consequently, a better display function can be demonstrated by the electrophoretic device 20. The size of the microcapsules 21 can be made uniform by for example, percolation, screening, segregation using difference in specific gravity and the like.

The size of the microcapsule 21 (average particle diameter) is not particularly limited, however, about 10-150 μm is preferable and about 30-100 μm is more preferable.

Furthermore, it is desirable that the microcapsule in the present embodiment is arranged between the pixel electrode and the common electrode so as to be in contact with the opposite electrodes, and formed into a flat shape along at least either one of the pixel electrode or the common electrode. Consequently, a better display function can be demonstrated by the electrophoretic device 20.

Moreover, in the electrophoretic device according to the present embodiment, the structure may be such that a binder material is provided between the pixel electrode 7 and the common electrode 8, and around the microcapsule 21. That is, in the present embodiment, the binder material may be a component of the electrophoretic device. By providing the binder material in this manner, each microcapsule is solidly fixed, and the microcapsule can be protected from mechanical shock. Furthermore the adhesive strength of the microcapsule and the pixel electrode or the common electrode can be enhanced.

As such a binder material, it is not particularly limited as long as it has a good affinity and adhesiveness with the wall-film material of the microcapsule 21 and has insulation performance. Examples thereof include for example, polyethylene, chlorinated polyethylene, ethylene-vinyl acetate copolymer, ethylene-ethyl acrylate copolymer, polypropylene, ABS resin (acrylonitrile-butadiene-styrene copolymer), methyl methacrylate resin, vinyl chloride resin, vinyl chloride-vinyl acetate copolymer, vinyl chloride-vinylidene chloride copolymer, vinyl chloride-acrylic ester copolymer, vinyl chloride-methacrylic acid copolymer, vinyl chloride-acrylonitrile copolymer, ethylene-vinyl alcohol-vinyl chloride copolymer, propylene-vinyl chloride copolymer, vinylidene chloride resin, vinyl acetate resin, polyvinyl alcohol, polyvinyl formal, cellulose-based resin, or other thermoplastic resin, polyamide-based resin, polyacetal, polycarbonate, polyethylene terephthalate, polybutylene terephthalate, polyphenylene oxide, polysulfone, polyamide imide, polyamino bismaleimide, polyether sulfone, polyphenylene sulfone, polyarylate, grafted polyphenylene ether, polyether ether ketone, polyether imide, and other polymers, polyethylene tetrafluoride, polyethylene propylene fluoride, ethylene tetrafluoride-perfluoroalkoxyethylene copolymer, ethylene-ethylene tetrafluoride copolymer, polyvinylidene fluoride, polyethylene trifluorochloride, fluororubber, or other fluororesins, silicone resins, silicone rubber, and other silicone resins. Examples also include as other binder material, methacrylic acid-styrene copolymer, polybutylene, methyl methacrylate-butadiene-styrene copolymer, and other various resin material. Such material alone or in combinations of two or more types can be used.

Moreover, the permittivity of the binder material and the permittivity of the liquid dispersion medium 6 are preferably approximately the same. Therefore, a permittivity modifier, such as 1,2-butanediol, 1,4-butanediol, and other alcohols, ketones and carboxylates, is preferably added to the binder material.

A composite film of the microcapsule and the binder material can be obtained in the following way. For example, the microcapsules and the permittivity modifier if necessary are mixed into the binder material, then the obtained resin composition (emulsion or organic solvent solution) is provided on the pixel electrode or a transparent electrode by, for example, a roll coater method, roll laminator method, screen printing method, spray method, ink-jet method or other application method.

Embodiment 5

Figure 5A:
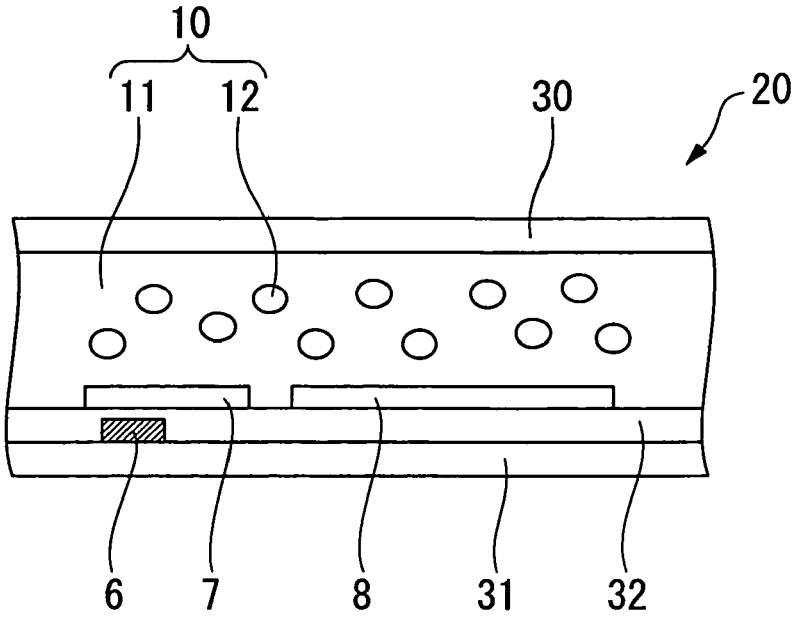
FIG. 5A is a sectional view showing an example of a pixel portion of a fifth embodiment of an electrophoretic device according to the present invention.

FIG. 5A is a sectional view showing the structure a pixel portion in a fifth embodiment of the electrophoretic device according to the present invention.

The present electrophoretic device includes the first substrate 30, the second substrate 31 provided to oppose the first substrate, the common electrode 8 and the pixel electrode 7 formed on the second substrate, and the switching element 6 that turns ON/OFF a signal supplied to the pixel electrode. Furthermore, the electrophoretic dispersion liquid 10 that includes the liquid dispersion medium 111 and the electrophoretic particles 12 is enclosed in the space between the first substrate 30 and the second substrate 31.

For the liquid dispersion medium 11 and the electrophoretic particle 12 in the present embodiment, materials similar to the ones described in Embodiment 1 may be used.

In the electrophoretic device of the present embodiment, the electrophoretic particles 12 move horizontally with respect to the substrate according to the electric field applied between the common electrode 8 and the pixel electrode 7. Therefore, the difference in an in-plane distribution of the particles between when the particles are deposited on the common electrode and when the particles are deposited on the pixel electrode, is used to display a picture.

Hereunder is a description of the operation of the present electrophoretic device. In the following description, it is assumed that the electrophoretic particles 12 are positively charged. However, even if they are negatively charged, the direction of applying the voltage need only be reversed, and the same principal can be applied for explanation.

In FIG. 5A, when the negative first voltage (for example −10V) is applied to the pixel electrode while keeping the common electrode 8 at the earth potential (i.e., 0V), an electric field is generated from the common electrode to the pixel electrode, and the positively charged electrophoretic particles migrate toward the pixel electrode along the electric field. On the other hand, when the positive second voltage (for example +10V) is applied to the pixel electrode while keeping the common electrode 8 at the earth potential (i.e., 0V), an electric field is generated from the pixel electrode to the common electrode. Therefore, the positively charged electrophoretic particles migrate toward the common electrode.

In FIG. 5A, the common electrode 8 is shown larger than the pixel electrode 7. However, this is simply for the sake of convenience and the size may be appropriately determined according to the desired image property. Therefore, there is no problem if the pixel electrode 7 is larger than the common electrode 8 or they are the same size.

Figure 5B:
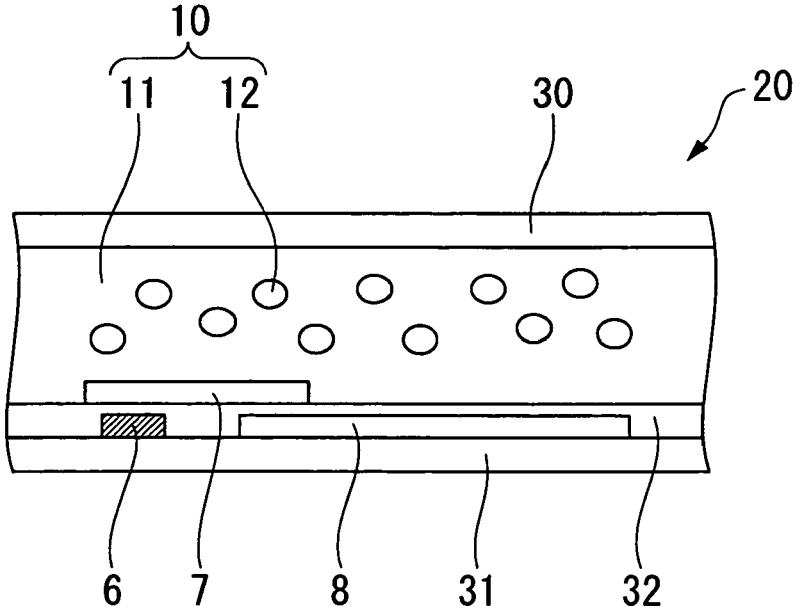
FIG. 5B is a sectional view showing another example of a pixel portion of a fifth embodiment of an electrophoretic device according to the present invention.

Furthermore, it is not necessary to arrange the common electrode 8 and the pixel electrode 7 on the same plane. For example, as shown in FIG. 5B, the structure may be such that the pixel electrode 7 is overlapped on the common electrode 8.

Embodiment 6

Hereunder is a description of embodiments of the electronic apparatus according to the present invention.

<<Cellular Phone>>

First is a description of an embodiment where the electronic apparatus of the present invention is applied to a cellular phone.

Figure 6:
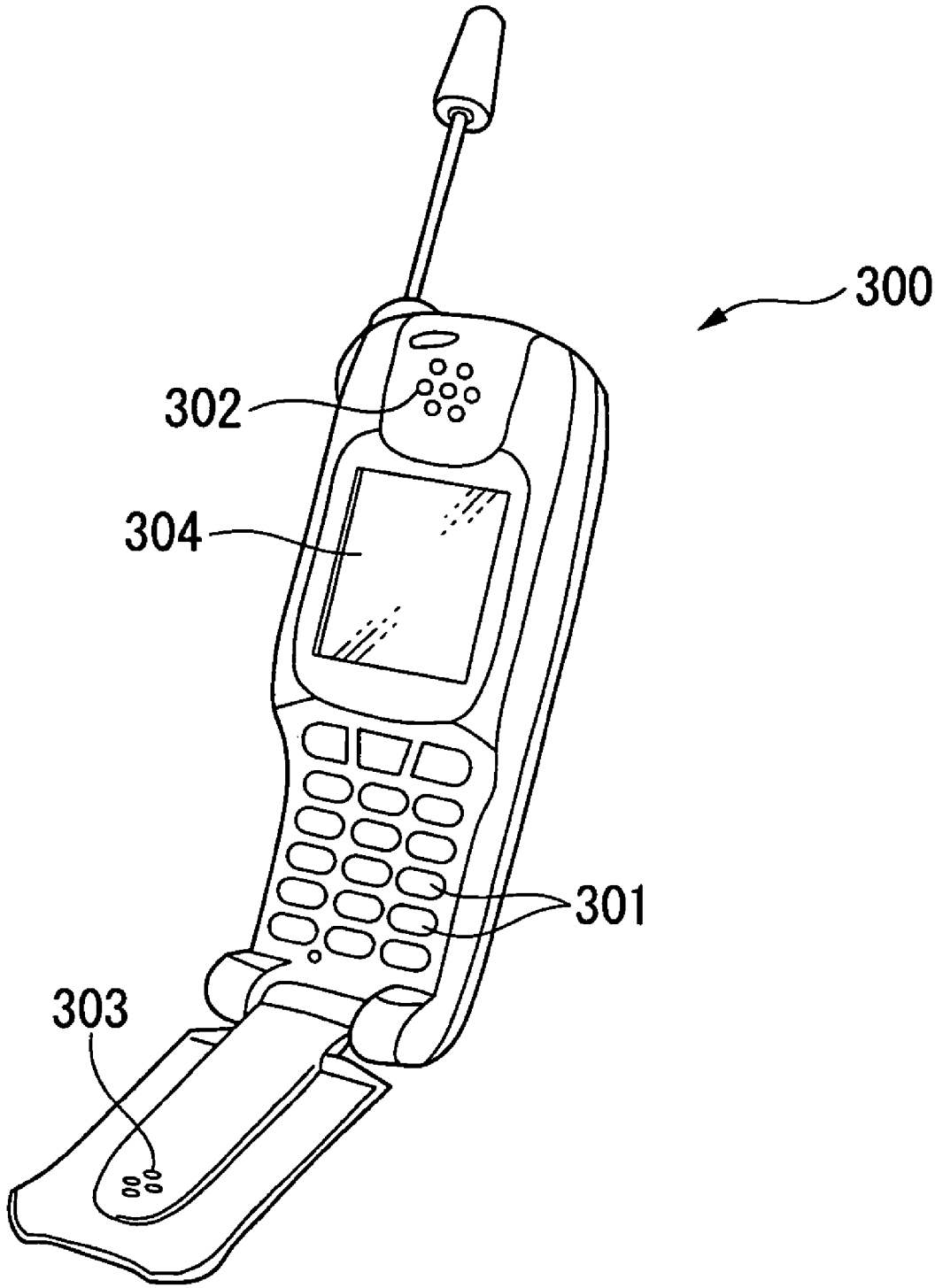
FIG. 6 is a perspective view showing an embodiment where the electronic apparatus of the present invention is applied to a cellular phone.

FIG. 6 is a perspective view showing an embodiment where the electronic apparatus of the present invention is applied to a cellular phone. A cellular phone 300 shown in FIG. 6 has a plurality of operation buttons 301, an ear piece 302, a mouth piece 303 and a display panel 304.

In such a cellular phone 300, the display panel 304 is constituted by the above-mentioned electrophoretic device 20.

<<Digital Still Camera>>

Next is a description of an embodiment where the electronic apparatus of the present invention is applied to a digital still camera.

Figure 7:
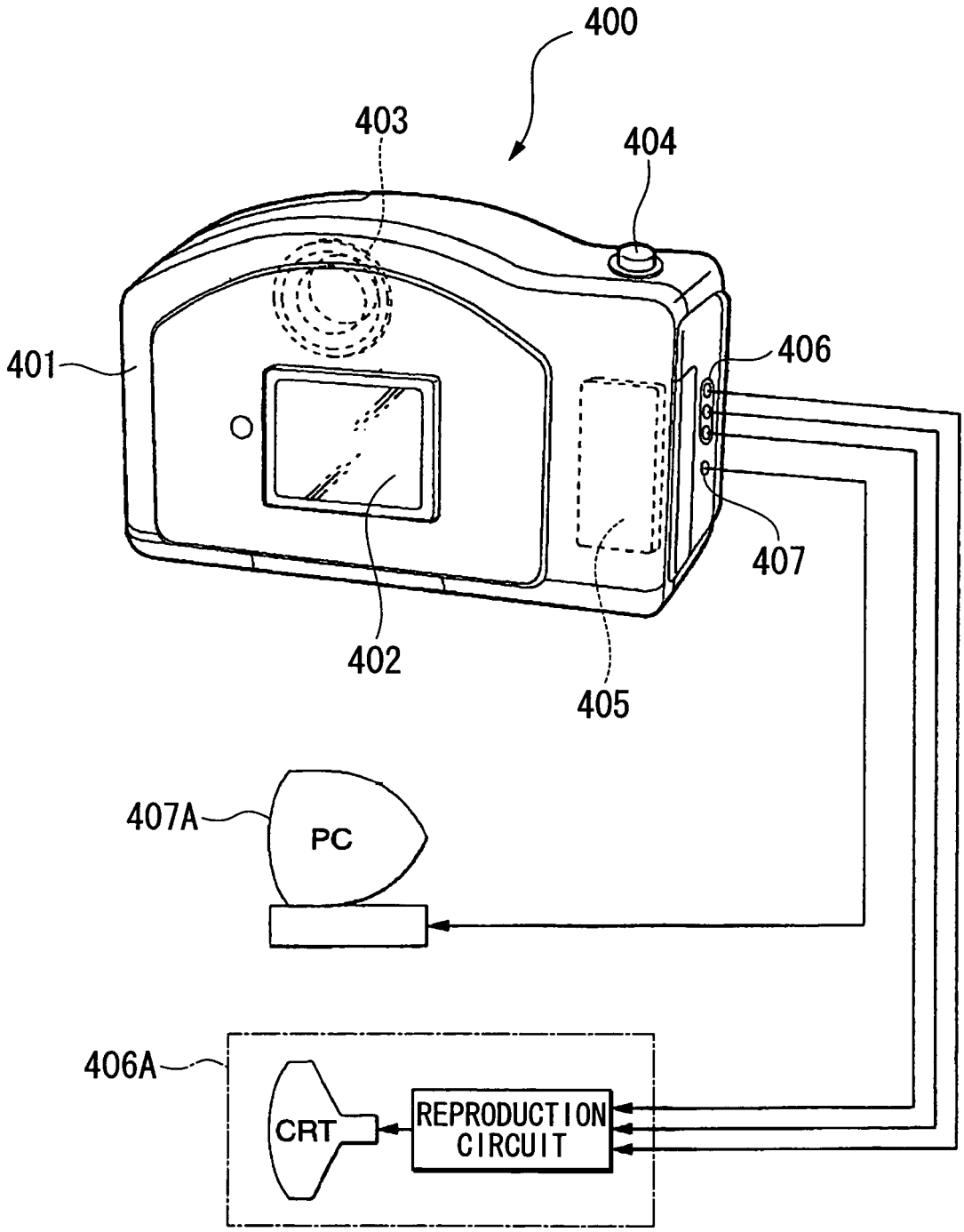
FIG. 7 is a perspective view showing an embodiment where the electronic apparatus of the present invention is applied to a digital still camera.

FIG. 7 is a perspective view showing an embodiment where the electronic apparatus of the present invention is applied to a digital still camera. In FIG. 7, the back side of the page is called "front face of the camera", and the front side of the page is called "back face of the camera". The connection state with external devices is also schematically shown in FIG. 7.

A digital still camera 400 shown in FIG. 7 has a case 401, a display panel 402 formed on the back face of the case 401, a light receiving unit 403 formed on a viewing side (in FIG. 7, the front face) of the case 401, a shutter button 404 and a circuit board 405. The light receiving unit 403 has, for example, an optical lens, a charge coupled device (CCD) and the like.

Moreover, the display panel 402 displays based on image signals from the CCD.

The image signal of the CCD at the time of pressing the shutter button 404 is transferred and stored into the circuit board 405.

Moreover, in the digital still camera 400 of the present embodiment, a video signal output terminal 406, and an input-output terminal 407 for data communication are provided on a side surface of the case 401.

Among these, for example, a television monitor 406A is connected to the video signal output terminal 406, and a personal computer 407A is connected to the input-output terminal 407 if necessary.

This digital still camera 400 is configured so as to output the image signal stored in the memory of the circuit board 405 to the television monitor 406A, or the personal computer 407A, by a predetermined operation.

In such a digital still camera 400, the display panel 402 is constituted by the above-mentioned electrophoretic device 20.

<<Electronic Book>>

Next is a description of an embodiment where the electronic apparatus of the present invention is applied to an electronic book.

Figure 8:
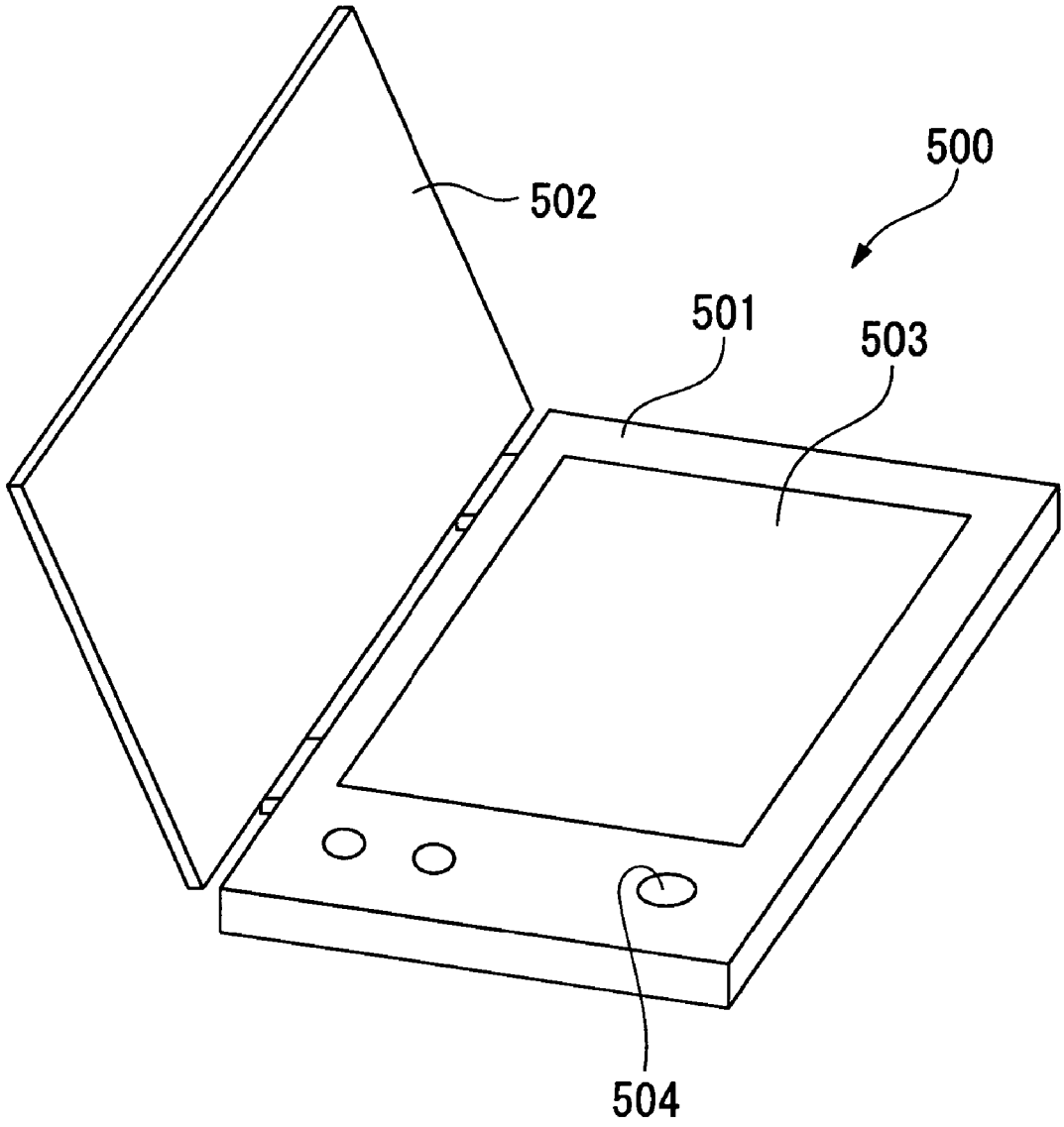
FIG. 8 is a perspective view showing an embodiment where the electronic apparatus of the present invention is applied to an electronic book.

FIG. 8 is a perspective view showing an embodiment where the electronic apparatus of the present invention is applied to an electronic book.

An electronic book 500 shown in FIG. 8 has a book shaped frame 501, and a turnable (openable and closable) cover 502 for the frame 501.

In the frame 501, a display panel 503 having the display surface exposed and an operating member 504 are installed.

In such an electronic book 500, the display panel 503 is constituted by the above-mentioned electrophoretic device 20.

<<Electronic Paper>>

Next is a description of an embodiment where the electronic apparatus of the present invention is applied to an electronic paper.

Figure 9:
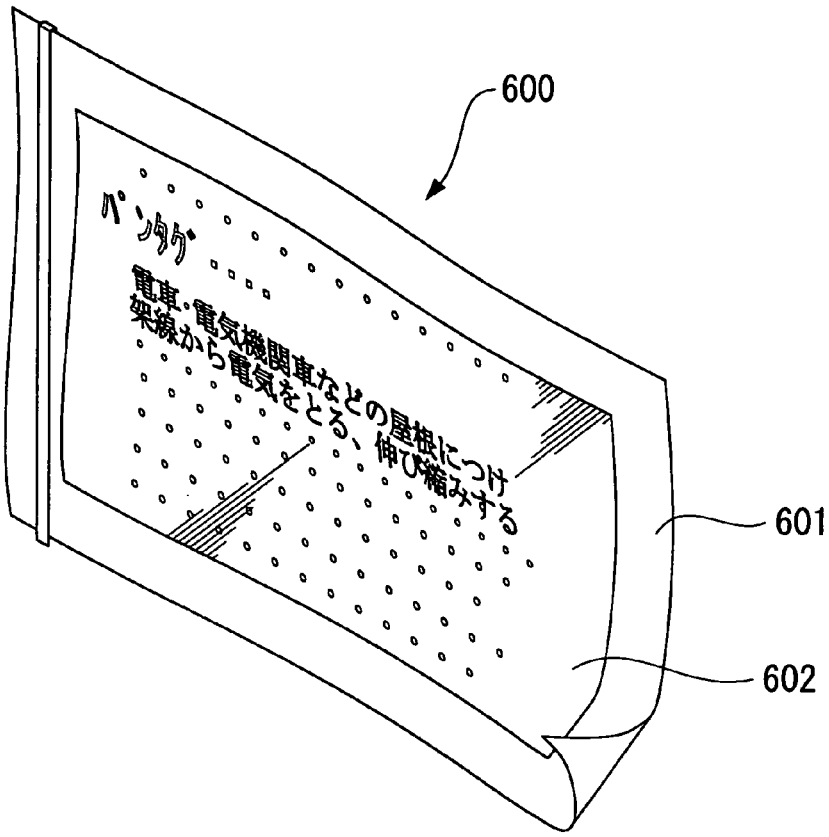
FIG. 9 is a perspective view showing an embodiment where the electronic apparatus of the present invention is applied to an electronic paper.

FIG. 9 is a perspective view showing an embodiment where the electronic apparatus of the present invention is applied to an electronic paper.

An electronic paper 600 shown in FIG. 9 has a main body 601 that is constituted by a rewritable sheet having the same texture and flexibility as that of paper, and a display unit 602.

In such electronic paper 600, the display unit 602 is constituted by the above-mentioned electrophoretic device 20.

<<Electronic Notebook>>

Next is a description of an embodiment where the electronic apparatus of the present invention is applied to an electronic notebook.

Figure 10:
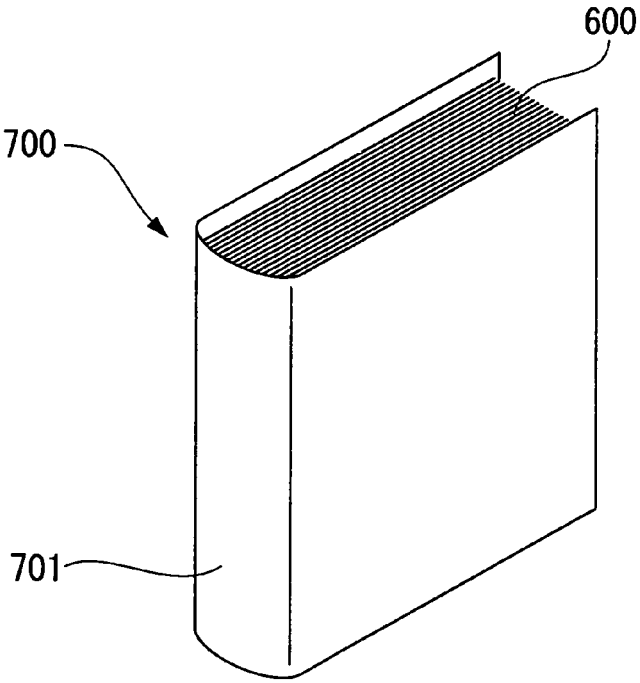
FIG. 10 is a perspective view showing an embodiment where the electronic apparatus of the present invention is applied to an electronic notebook.

FIG. 10 is a perspective view showing an embodiment where the electronic apparatus of the present invention is applied to an electronic notebook.

An electronic notebook 700 shown in FIG. 10 has a cover 701, and the electronic paper 600.

The electronic paper 600 has the above described structure, that is, a similar structure to that shown in FIG. 9. A plurality of these are bundled together so as to be interposed in the cover 701.

Moreover, an input device which inputs display data is also provided in the cover 701. As a result, the display contents can be changed with the electronic papers 600 in the bundled condition.

In such an electronic notebook 700, the electronic paper 600 is constituted by the above-mentioned electrophoretic device 20.

<<Display>>

Next is a description of an embodiment where the electronic apparatus of the present invention is applied to a display.

Figure 11A:
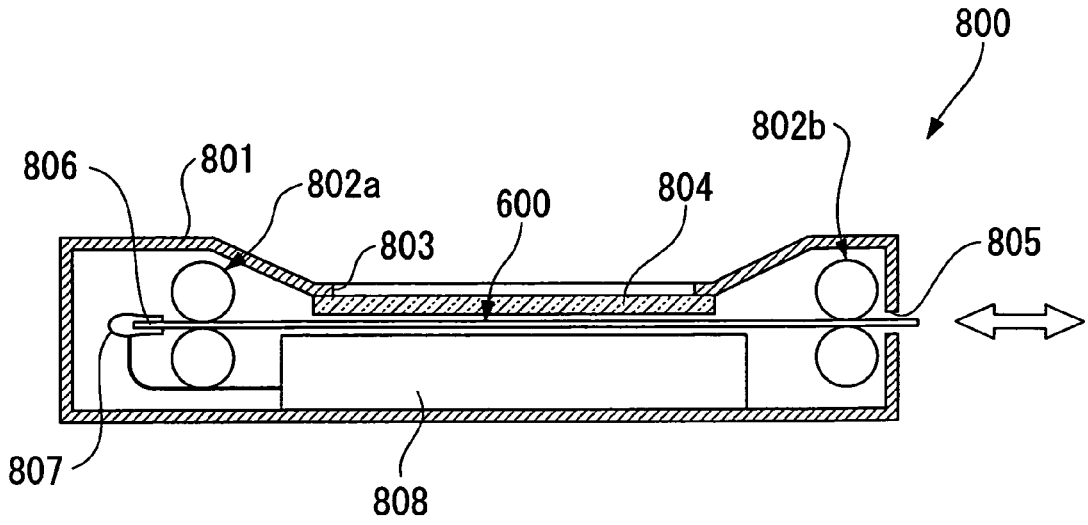
FIGS. 11A and 11B are schematic views showing an embodiment where the electronic apparatus of the present invention is applied to a display.
Figure 11B:
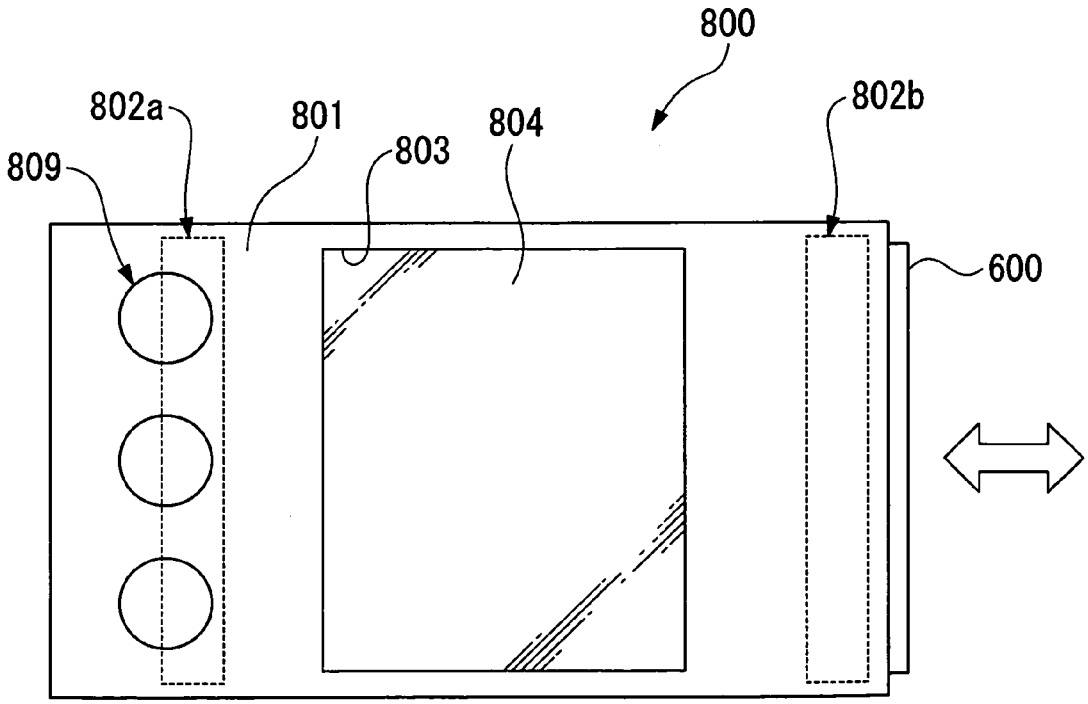
Figure 13A:
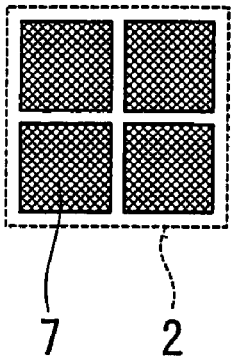
FIGS. 13A to 13E are sectional views showing a case where a conventional electrophoretic device has four pixel electrodes.
Figure 13B:
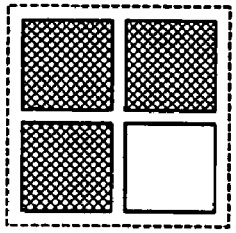
Figure 13C:
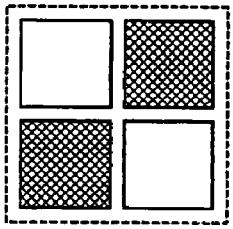
Figure 13D:
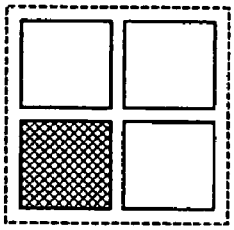
Figure 13E:
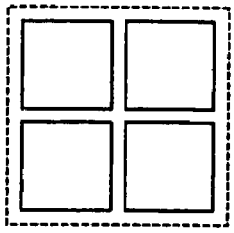

FIGS. 11A and 11B show an embodiment where the electronic apparatus of the present invention is applied to a display. FIG. 11A is a sectional view, and FIG. 11B is a plan view.

A display (electrophoretic device) 800 shown in FIG. 11 has a main body 801, and the electronic paper 600 provided so as to be detachable with respect to the main body 801. The electronic paper 600 has the above described structure, that is, a similar structure to that shown in FIG. 9.

An insertion slot 805 into which the electronic paper 600 can be inserted is formed on the side (right side in FIG. 11) of the main body 801. Moreover, two pairs of carrier rollers 802*a* and 802*b* are provided inside of the main body 801. When the electronic paper 600 is inserted into the main body 801 through the insertion slot 805, the electronic paper 600 is provided into the main body 801 while being interposed between the carrier rollers 802*a* and 802*b*.

A rectangular opening 803 is formed on a display side (the front side of the page in FIG. 11B) of the main body 801, and a transparent glass plate 804 is embedded in the opening 803. As a result, the electronic paper 600 that is set into the main body 801 is visible from the outside of the main body 801. That is, the display 800 constitutes a screen which displays a picture by viewing the electronic paper 600 set into the main body 801 through the transparent glass plate 804.

Moreover, a terminal member 806 is provided on a fore-end of the electronic paper 600 in the insertion direction (left side in FIG. 11). A socket 807, to which the terminal member 806 is connected in a condition where the electronic paper 600 is set into the main body 801, is provided inside the main body 801. A controller 808 and an operating part 809 are electrically connected to the socket 807.

In such a display 800, the electronic paper 600 is detachably set into the main body 801, and it can be portably used in a condition while detached from the main body 801.

Moreover, in such a display 800, the electronic paper 600 is constituted by the above-mentioned electrophoretic device 20.

The electronic apparatus of the present invention is not limited to application to the above-mentioned items. Application examples include a television, a view finder type or monitor direct view type video tape recorder, a car navigation device, a pager, an electronic databook, a calculator, an electronic newspaper, a word processor, a personal computer, a work station, a videophone, a point-of-sale terminal, equipment having a touch panel, and so forth. The electrophoretic device 20 of the present invention can be applied to the display parts of these various electronic apparatus.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

According to the electrophoretic device of the present invention, the desired optical characteristic can be accurately obtained for the gradation expression, in particular in the area gradation.

What is claimed is:

1. An electrophoretic device comprising:

an electrophoretic dispersion liquid that includes a liquid dispersion medium and electrophoretic particles;

a plurality of pixel electrodes; and a voltage supply device that separately supplies a plurality of said pixel electrodes with a first voltage or a second, voltage according to a proportion "x", the proportion "x" being a proportion of a number of pixel electrodes supplied with the first voltage and a number of pixel electrodes supplied with the second voltage, wherein for each of a plurality of values of the proportion "x", a measured value R is obtained by measuring an actual optical characteristic in advance, and when an image is displayed, a modified proportion "x" corresponding to a desired optical characteristic of the image is calculated based on the measured value R and the modified proportion "x" is used by the voltage supply device.

2. An electrophoretic device according to claim 1, wherein based on a function $R=f(x)$ representing the relationship of said proportion "x" and the measured value R of said optical characteristic, an inverse function $x=f^{-1}(R)$ is obtained in advance, and when an image is displayed, the modified proportion "x" corresponding to the desired optical characteristic is calculated by substituting said desired optical characteristic as a value R by the inverse function $x=f^{-1}(R)$.

3. An electrophoretic device according to claim 1, wherein said electrophoretic particles comprise a plurality of types of particles having different optical characteristics.

4. An electrophoretic device according to claim 1, wherein said electrophoretic dispersion liquid is encapsulated in a microcapsule.

5. An electrophoretic device according to claim 1, wherein said pixel electrodes are arranged in matrix form.

6. An electrophoretic device according to claim 1, having a common electrode, and said pixel electrode and said common electrode are formed on a same substrate.

7. Electronic apparatus comprising the electrophoretic devices according to claim 1.

8. A method of driving an electrophoretic device, said electrophoretic device comprising:

an electrophoretic dispersion liquid that includes a liquid dispersion medium and electrophoretic particles;

a plurality of pixel electrodes; and a voltage supply device that separately supplies a plurality of said pixel electrodes with a first voltage or a second voltage, and the method comprising:

when a proportion "x" is defined as a proportion of a number of pixel electrodes supplied with the first voltage and a number of pixel electrodes supplied with the second voltage, obtaining a measured value R for each of a plurality of values of the proportion "x", by measuring an actual optical characteristic in advance, and when displaying an image, calculating a modified proportion "x" corresponding to a desired optical characteristic based on said measured value R, and supplying said first voltage or said second voltage from said voltage supply device to a plurality of said pixel electrodes corresponding to said modified proportion "x".

9. A method of driving an electrophoretic device according to claim 8 wherein:

obtaining a function $R=f(x)$ representing the relationship of said proportion "x" and the measured value R of said optical characteristic; and preparing an inverse function $x=f^{-1}(R)$ of the function $R=f(x)$; and when displaying an image, calculating the modified proportion "x" corresponding to a desired optical characteristic R using the inverse function $x=f^{-1}(R)$, and supplying said first voltage or said second voltage from said voltage supply device to said plurality of pixel electrodes according to said calculated modified proportion "x".

10. Electronic apparatus comprising the electrophoretic devices according to claim 8.

* * * * *